US005083333A

United States Patent [19]

Newton

[11] Patent Number: 5,083,333

[45] Date of Patent: Jan. 28, 1992

[54] HINGE FOR CONVERTIBLE SOFA

[76] Inventor: John H. Newton, P.O. Box 10, West Hartford, Vt. 05084

[21] Appl. No.: 673,946

[22] Filed: Mar. 22, 1991

[51] Int. Cl.[5] ..... A47C 17/17

[52] U.S. Cl. ..... 5/37.1; 5/47; 5/57.2

[58] Field of Search ..... 5/37.1, 41, 42, 48, 5/57.2; 297/357

[56] References Cited

U.S. PATENT DOCUMENTS

| | | | |
|---|---|---|---|
| 677,671 | 7/1901 | Lawsen | 5/57.2 X |
| 1,596,316 | 8/1926 | Singleton | 297/357 |
| 2,209,880 | 7/1940 | Fox . | |
| 3,042,935 | 7/1962 | Nielsen . | |
| 3,107,364 | 10/1963 | Simmons . | |
| 3,634,853 | 1/1972 | Hern et al. | 5/37.1 |
| 4,168,860 | 9/1979 | Garza et al. | 5/47 X |
| 4,642,823 | 2/1987 | Wiggins . | |
| 4,737,996 | 4/1988 | Tiffany . | |
| 4,829,611 | 5/1989 | Fireman et al. . | |
| 4,875,244 | 10/1989 | Tremblay . | |
| 4,996,730 | 3/1991 | Fireman et al. | 5/37.1 |

*Primary Examiner*—Michael F. Trettel
*Attorney, Agent, or Firm*—Michael J. Weins

[57] ABSTRACT

The present invention is for a sofa bed recliner that can be simply opened into a bed or closed to form a sofa. The mechanism allows the sofa to be opened or closed while being in close proximity with a wall.

The mechanism also provides for the positive locking of the back frame element to the seat frame element both in the closed and open position to assure a rigid structure in both positions.

7 Claims, 6 Drawing Sheets

HINGE FOR CONVERTIBLE SOFA

FIELD OF INVENTION

The present invention relates to the frame of a convertible sofa bed recliner. More particularly to a hinge mechanism that will convert a sofa to a bed and vice versa.

BACKGROUND OF THE INVENTION

Convertible sofas or sofa bed recliners are well known. Many of these sofas require substantial effort to open the sofa, to convert the sofa to a bed or close the bed to form a sofa. For many of the currently available sofa bed recliners it is also required that the sofa bed recliner be a substantial distance from a wall when it is opened or closed. In addition, the frames currently available frequently require intricate mechanisms to maintain the bed in a rigid position when the sofa is open into a bed and to maintain the sofa back and seat firmly in position when the sofa is in the closed position.

The problem associated with opening a sofa when in close proximity to a wall has been addressed by U.S. Pat. No. 4,875,244. However, the frame described therein does not provide means for rigidly maintaining the bed flat when the sofa is in the open position. Furthermore, the mechanism for opening and closing the sofa relies on a gravity activated cam and the mechanism can be subject to sticking.

The problem of maintaining a sofa in a rigid position when in the open position has been overcome in part by U.S. Pat. No. 4,642,823 which employs locking pins slidably mounted in the seat member of the sofa which slidably engage holes in the back member of the sofa when the sofa is opened to form a bed. The shortcoming of this mechanism is that alignment of the pins with the holes is critical.

Thus there is a need of a simple hinge mechanism that will provide for positive activated opening and closing of the sofa and will operate when the sofa is positioned near a wall.

SUMMARY OF THE INVENTION

It is an object of the invention to provide a hinge mechanism for a sofa bed recliner that is positively activated to open and close a sofa or bed recliner.

It is another object of the invention to provide a sofa bed recliner where the back and seat frames are firmly held in position when the sofa bed recliner is closed for use as a sofa.

It is still a further object of the invention to provide a sofa bed recliner which when opened forms a rigid flat bed.

It is yet another object of the invention to provide a sofa bed recliner which can be opened and closed when in close proximity to a wall.

It is still a further object of the invention to provide a pad-bearing sofa bed recliner that does not require removal or rearrangement of the pad which serves as a back and seat pad when the sofa is closed and as a mattress when the sofa is open.

These and other objects of the invention will become apparent from the following description, drawings, and claims.

The present invention is directed to a sofa bed recliner and in particular to the hinging mechanism for opening the sofa bed recliner. In its simplest form the principal structural elements of the sofa bed recliner are a main frame, back frame, and a seat frame.

The main frame has a first main frame end and a second main frame end which are spaced apart from and substantially parallel to each other. The first main frame end has a first guide groove therein and the second main frame end has a second guide groove therein.

The back frame has a first back frame member and a second back frame member which are spaced apart and substantially parallel to each other. The first back frame member terminates in a first back frame end with a first longitudinal notch being positioned longitudinally, that is parallel to the length of the member, and a first normal notch which is substantially normal to the first longitudinal notch.

The second back frame member terminates in a second back frame end with a second longitudinal notch being positioned longitudinally, that is parallel to the length of the member, and a second normal notch which is substantially normal to the second longitudinal notch.

A first guide groove follower is attached to the first back frame member, and engages the first guide groove. While a second guide groove follower is attached to the second back member and engages the second guide groove.

A first link arm is pivotally connected to the first main frame end and is pivotally connected to the first back frame member. While a second link arm is pivotally connected to the second frame end and is pivotally connected to the second back frame member.

The seat frame has a first seat frame member and a second seat frame member which are spaced apart and substantially parallel to each other.

The first seat frame member terminates in a first seat frame member end with a slotted opening therein. While the second seat frame member terminates in a second seat frame member end with a second slotted opening therein.

A first back frame pin attaches to the first back frame member end of the first back frame member and engages the first slotted opening in the first seat frame member end.

A second back frame pin attaches to the second back frame member end of the second back frame member and engages the second slotted opening in the second seat frame member end.

A first seat pin is attached to the first seat frame member end and is so positioned that it can be slidably engaged with the first longitudinal notch and the first normal notch in the first back frame member end.

Similarly a second seat pin is attached to the second seat frame member end and is so positioned that it can be slidably engaged with the second longitudinal notch and the second normal notch in the second back frame member end.

BRIEF DESCRIPTION OF THE DRAWINGS

FIG. 1 illustrates the three frames that form the underlying support structure for the sofa bed recliner.

FIG. 2 illustrates a main frame end, a back frame member, a seat frame member, and a link arm. The position of the elements illustrated in FIG. 2 is the position assumed by them when the sofa bed is in the closed position and serves as a sofa.

DETAILED DESCRIPTION OF THE INVENTION

Figure 1:
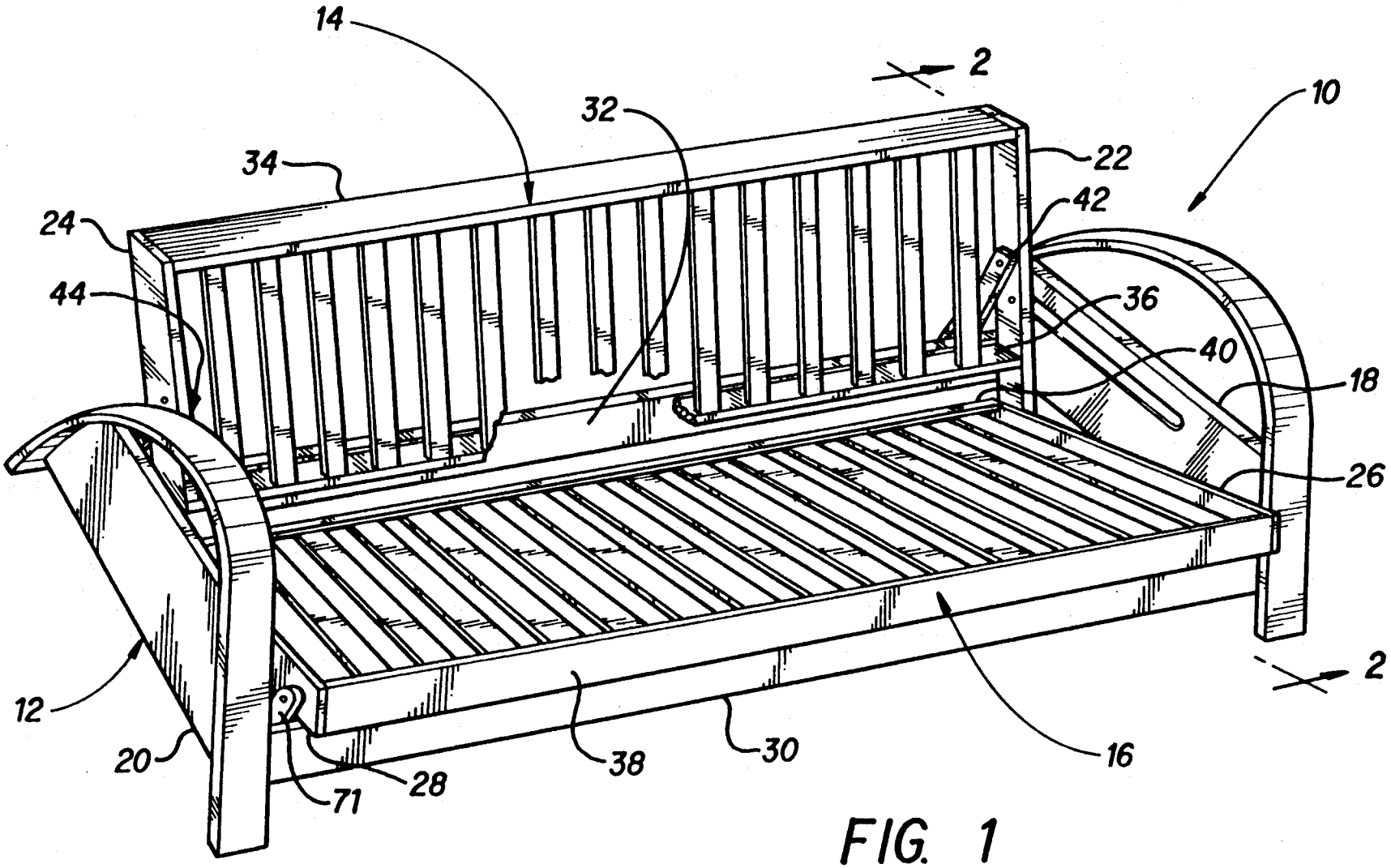
FIG. 1 is a schematic representation of a sofa bed recliner of the present invention.

FIG. 1 is a schematic representation of a sofa bed recliner 10 of the present invention. The frame has three principal structural elements: a main frame 12, a back frame 14, and a seat frame 16.

The main frame 12 has a first main frame end 18 and a second main frame end 20 which are spaced apart and substantially parallel. The back frame 14 has a first back frame member 22 and a second back frame member 24 which are spaced apart and substantially parallel. Similarly the seat frame 16 has a first seat frame member 26 and a second seat frame member 28 which are spaced apart and substantially parallel.

The parallel relationship between the various frame elements is preferably maintained by a series of cross members. For the main frame 12 a front main frame cross member 30 and a rear main frame cross member 32 maintain the separation of the main frame ends and provide rigidity to the main frame 12.

For the back frame 14, the parallel relationship is maintained by a back top cross member 34 and a back bottom cross member 36. Similarly for the seat frame 16, the parallel relationship is maintained by a seat front cross member 38 and a seat rear cross member 40.

A first link arm 42 pivotally connects to the first main frame end 18 and pivotally connects to the first back frame member 22. A second link arm 44 pivotally connects to a second main frame end 20 and pivotally connects to the second back frame member 24. These first link arm 42 and the second link arm 44 provide additional support to the back frame 14 when the sofa bed recliner 10 is in the closed position. The first link arm 42 and the second link arm 44 ensure that the seat rear cross member 40 of the seat frame 16 will remain parallel to the front main frame cross member 30 of the main frame 12 during opening and closing of the sofa bed recliner 10. Maintaining a parallel relationship of the seat rear cross member 40 with respect to the front main frame cross member 30 during opening and closing of the sofa avoids binding during opening and closing.

Figure 2:
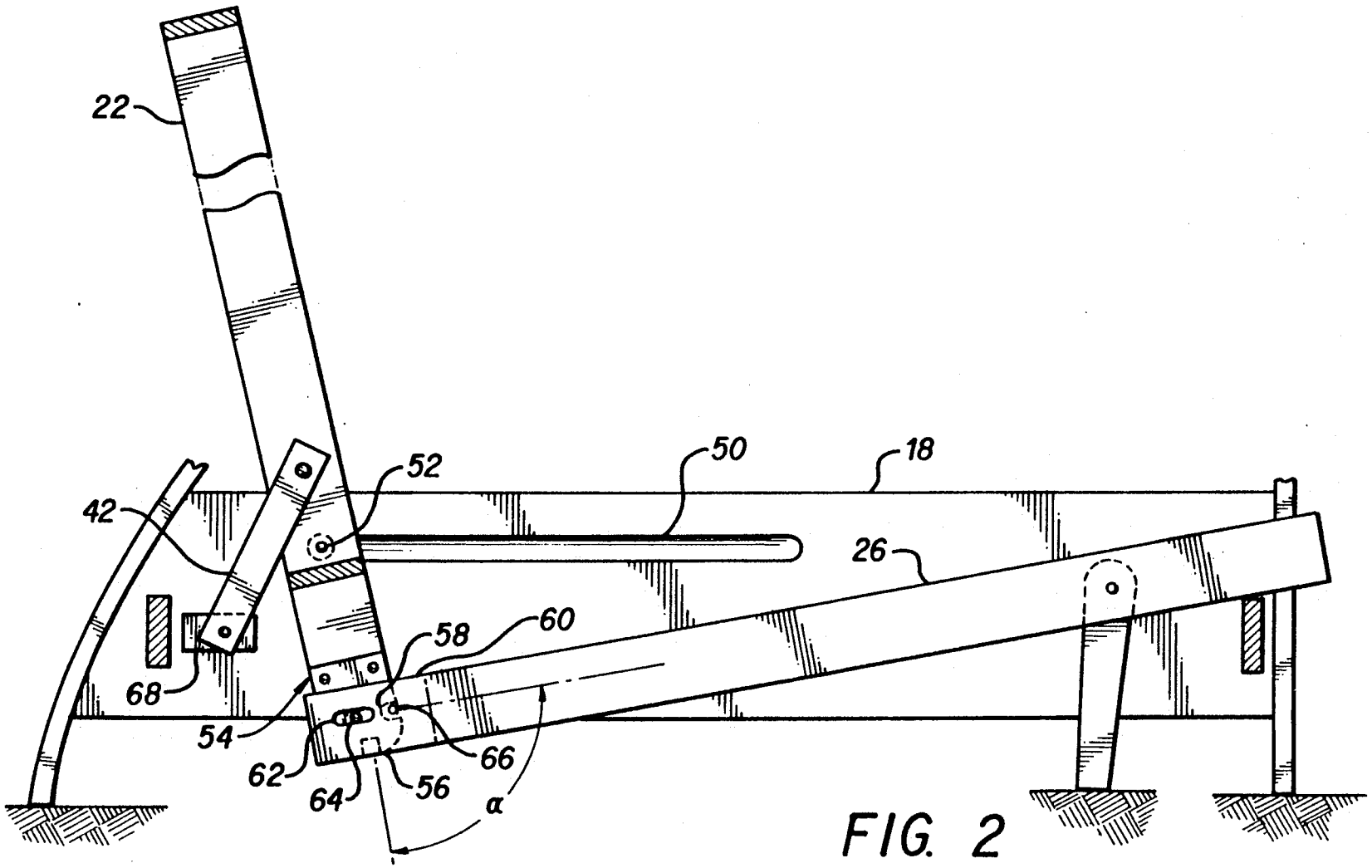
FIG. 2 is a view of section 2—2 of FIG. 1 showing a side view of selective elements which cooperate to form a hinge element.

FIG. 2 illustrates the connectivity of the first main frame end 18, the first back frame member 22, and the first seat frame member 26, as well as additional structural elements which are employed to provide the hinge of the present invention. Detailed description and analysis of the additional structural elements will be made with respect to the first main frame end 18. It should be appreciated that there are corresponding members associated with the second main frame end 20 shown in FIG. 1 and that their description would parallel the description of the elements of those associated with the first main frame end 18. The first main frame end 18 has a first guide groove 50 contained therein. A first guide groove follower 52 is attached to the first back frame member 22 and engages the first guide groove 50.

The first back frame member 22 has a first back frame member end 54. The first back frame member end 54 has a first longitudinal notch 56 positioned longitudinally therein and a first normal notch 58 substantially normal to the first longitudinal notch 56.

Preferably the angle $\alpha$ between the first longitudinal notch 56 and the first normal notch 58 is about 88°. This value is slightly less than 90° so as to provide a corresponding relaxation from the orthogonal between the back frame 14 and the seat frame 16 thereby increasing the comfort of the sofa bed recliner 10 of the present invention.

The first seat frame member 26 has a first seat frame end 60. The first seat frame end 60 has in turn a first slotted opening 62 passing therethrough.

A first back frame pin 64 is attached to the first back frame member end 54 and is so positioned to engage the first slotted opening 62 in the first seat frame end 60.

A first seat frame pin 66 is attached to the first seat frame end 60 and so positioned that it can be slidably engaged with the first normal notch 58 of the first back frame member end 54 of the first back frame member 22, as illustrated in FIG. 2. With the members positioned as illustrated in FIG. 2, the sofa bed recliner 10 is closed and serves as a sofa.

Preferably a first mounting block 68 is attached to the first main frame end 18 and serves as a spacer via which the first link arm 42 is pivotally connected to the first main frame end 18. The block 68 preferably has a thickness such that when the link arm 42, when pivotably connected to the first main frame end 18 via the block 68 and the first back frame member 22, is substantially parallel to both the first main frame end 18 and the first back frame member 22.

Figure 3:
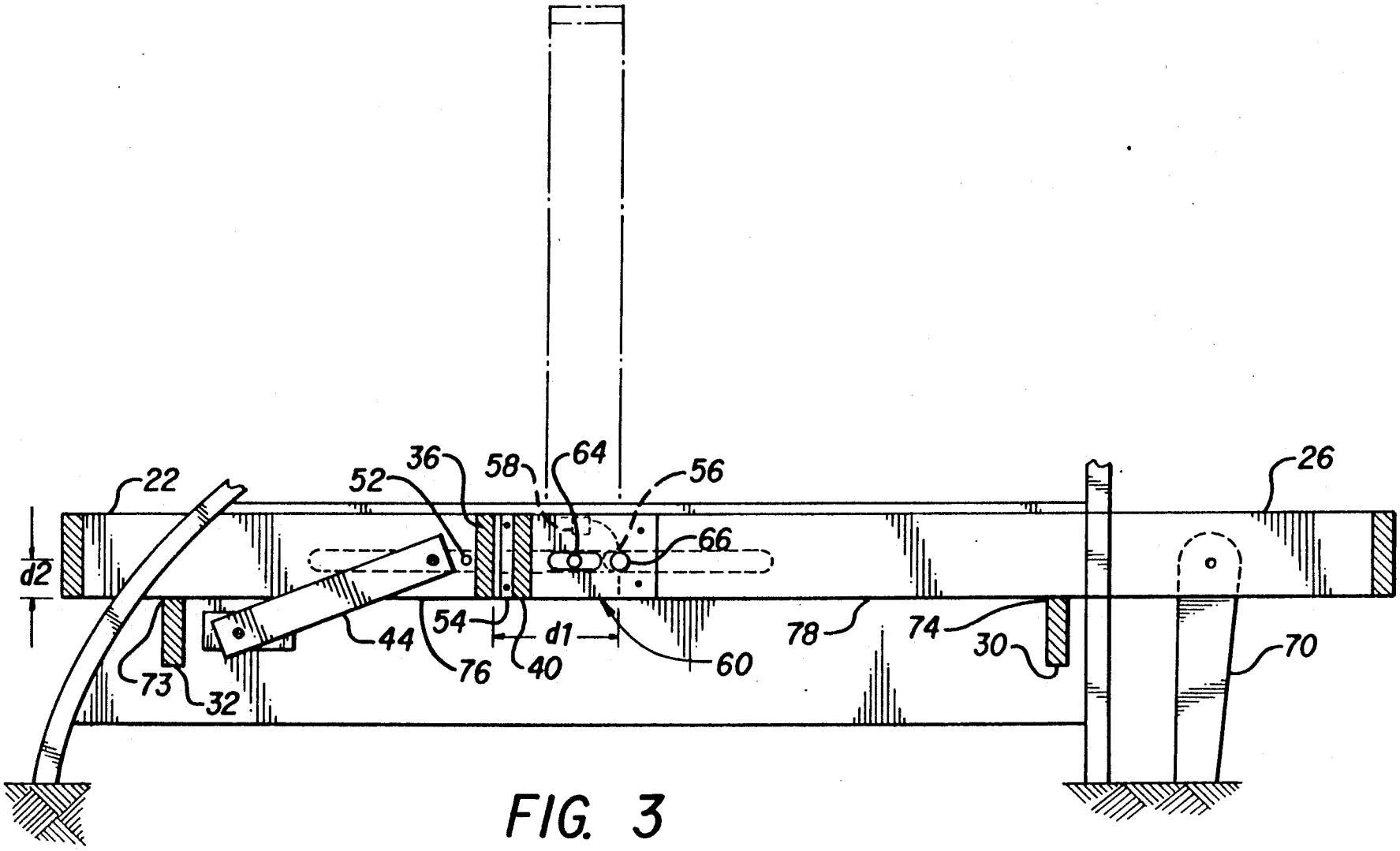
FIG. 3 is a view of the same elements shown in FIG. 2, however the elements have been repositioned to the positions assumed by the elements when the sofa bed recliner is in the open position and serves as a bed. A phantom line shows the position of the seat frame after the back frame has been lowered to the bed position but before the seat frame has been disengaged from the notches that hold the seat essentially normal to the back frame.

FIG. 3 is a side view of the same elements shown in FIG. 2, however the sofa bed recliner frame members are in the position assumed when the sofa bed recliner 10 functions as a bed. In this position the first seat frame pin 66 engages the first longitudinal notch 56 of the first back frame member end 54. A phantom line in FIG. 3 shows the position of the seat frame 16 after the back frame 14 has been lowered to the bed position but before the seat frame 16 has been disengaged from the notches that hold the seat frame 16 essentially normal to the back frame 14.

FIG. 3 shows a pivotally mounted first stabilizing leg 70 which is mounted on the first seat frame member 26. The first stabilizing leg 70 provides support for the extended section of the seat frame 16 of the sofa bed recliner 10 when it is opened into a bed. A second stabilizing leg 71 (illustrated in FIG. 1) provides additional support for the seat frame 16.

Also illustrated in FIG. 3 is the spacial relationship that should be maintained between the seat rear cross member 40 and the back bottom cross member 36 to ensure proper functioning of the back frame 14 of the sofa bed recliner 10 of the present invention.

The seat rear cross member 40 is preferably attached at the extremity of the first seat frame end 60, thereby ensuring maximum rigidity to the seat frame 16.

The back bottom cross member 36 is displaced from the extremity of the first back frame member end 54 a distance $d_1$ sufficient to allow the first seat frame end 60 to pivot about the first back frame pin 64 allowing the seat frame 16 to rotate into the plane of the back frame 18.

To ensure that the sofa bed recliner 10, when open, provides a planer bed surface the relative position of the front cross member 30, the rear main frame cross member 32 and the guide groove follower 52 is critical. Top surfaces 73 and 74 of the main frame cross member 30 and 32 should define a plane which is spaced apart from the axis of the first guide groove follower 52 by a distance $d_2$ which is equal to the distance from the axis of the first guide groove follower 52 and lower edges 76 and 78 of the first back frame member 22 and the first seat frame member 26.

Figure 4:
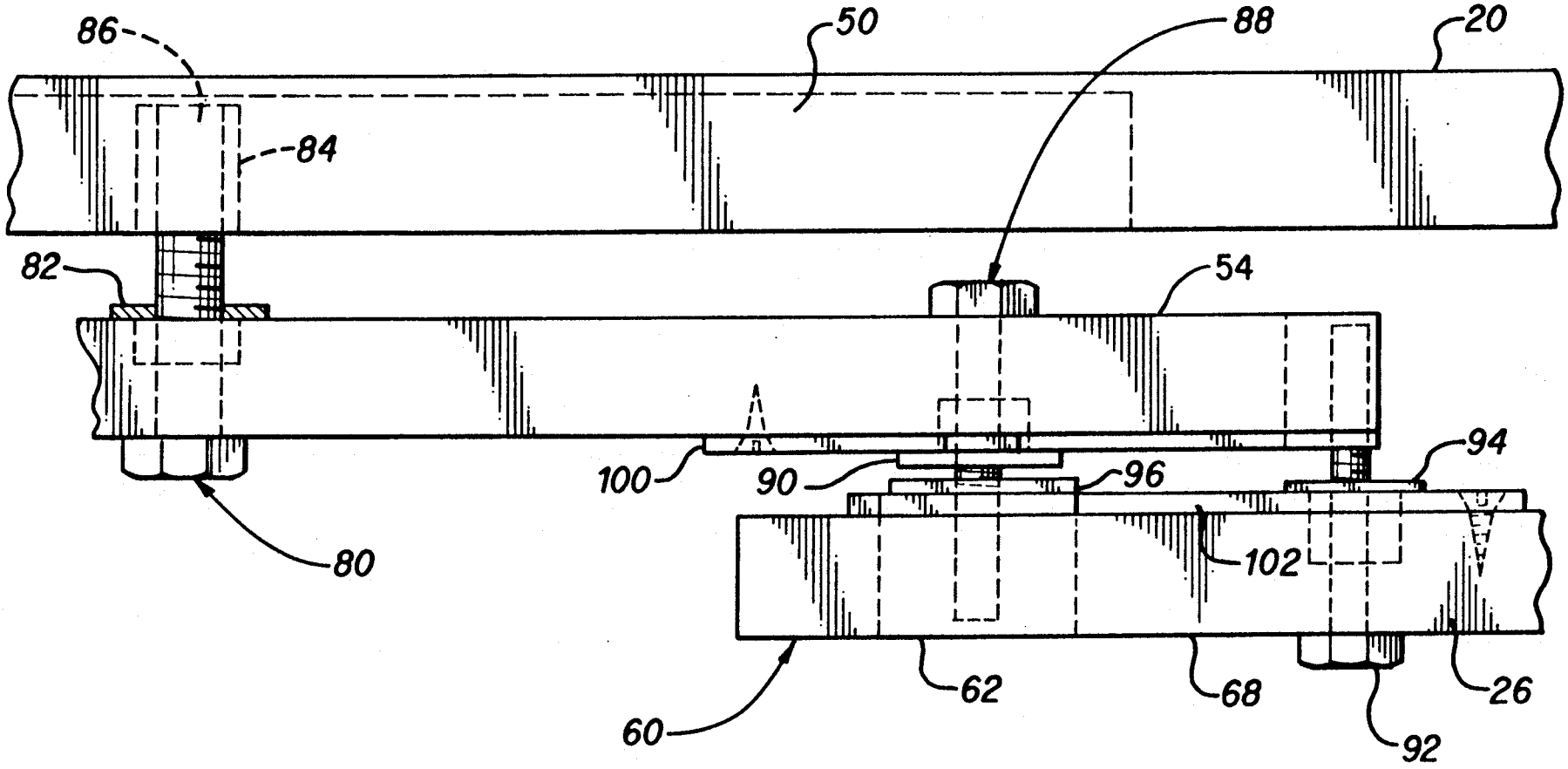
FIG. 4 is a top view of a preferred embodiment of the present invention which employs bolts for the guide groove followers, for seat pins, and for back pins employed in FIG. 3.

FIG. 4 is a preferred hinge configuration where bolts are employed for the guide groove followers, seat pins, and back pins. In this embodiment the groove followers such as the first guide groove follower 52 of FIG. 2 is replaced by bolt followers such as a first bolt follower 80 which passes through the first back frame member 22. These bolts in turn are secured in position by T-nuts as is illustrated by a first bolt follower T-nut 82 which secures the first bolt follower 80. The first bolt follower 80 extends into the first guide groove 50 as is illustrated. It is preferred that the follower bolts have bushings, as illustrated in FIG. 4, with a first bolt follower 80. A first bushing 84 mounts on the first bolt follower free end 86 of the first bolt follower 80. The bushings provide rolling contact between the guide grooves and the follower bolts. Such contact provides a smooth action when opening and closing the sofa bed recliner 10. It is further preferred that the guide groove is a blind groove. Having a blind groove ensures that the bushings will maintain the position on the bolt followers.

The embodiment of FIG. 4 also employs bolts for the back frame pins and the seat frame pins. For example, the first back frame pin 64 of FIG. 2 has been replaced with a first back frame bolt 88 which passes through the first back frame member 22 and extends into the first slotted opening 62 of the first seat frame end 60. The back frame bolt 88 is secured by a first back frame bolt T-nut 90. Similarly, by way of example, the first seat frame pin 66 of FIG. 2 has been replaced with a first seat frame bolt 92 which passes through the first seat frame member 26. A first seat frame bolt T-nut 94 secures the first seat frame bolt 92 to the first seat frame member 26.

Since the spacial separation between the seat frame bolts and the back frame bolts is limited, it is further preferred, to ensure clearance between the T-nuts and adjacent hinge members, that spacing washers be employed. As illustrated in FIG. 4, the first back frame bolt 88 passes through the spacing washer 96 and reduces the frictional torque required to open or close the sofa. The spacing washer 96 will also ensure that the separation between the first back frame bolt T-nut 90 and the first seat frame bolt T-nut 94, if the separation between the corresponding nuts cannot be maintained sufficient to provide clearance.

The embodiment shown in FIG. 4 also employs reinforcing plates. These plates provide additional strength to the back frame member ends and the seat frame member ends. The strength of these ends is reduced by the notches and slots contained therein. These strengthening plates are particularly important when the frames are wood. A first back reinforcing plate 100 is attached to the first back frame member 22 and overlays the first back frame member end 54. Similarly a first seat reinforcing plate 102 is attached to the first seat frame member 26 and overlays the first seat frame end 60.

Figure 5:
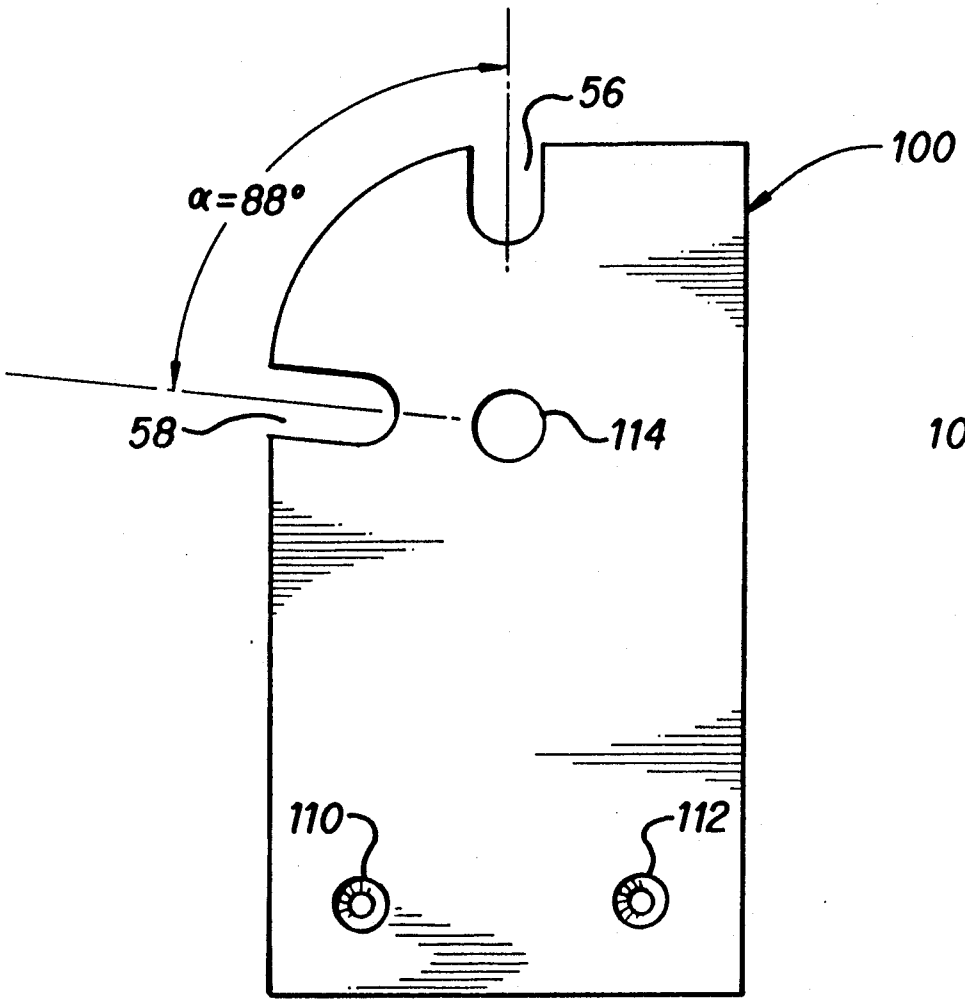
FIG. 5 is a side view of a back reinforcing plate for the preferred embodiment of FIG. 4.

FIG. 5 is a side view of the first back reinforcing plate 100 of FIG. 4 and shows additional details of the preferred plate configuration. The first back reinforcing plate 100 follows the profile of the first back frame member end 54. The first longitudinal notch 56 is included as well as the first normal notch 58. The angular specification between the first longitudinal notch 56 and the first normal notch 58 illustrated in FIG. 5 is for the preferred angle $\alpha$ of about 88°. The first back reinforcing plate 100 has three holes therethrough. A first back plate screw hole 110 and a second back plate screw hole 112 are provided to affix to the first back reinforcing plate 100 to the first back frame member 22. The third hole 114 which is not co-linear with the first screw hole 110 and the second screw hole 112 is provided for a T-nut to pass therethrough. These three points provide a triangular support putter to resist torsional forces.

Figure 6:
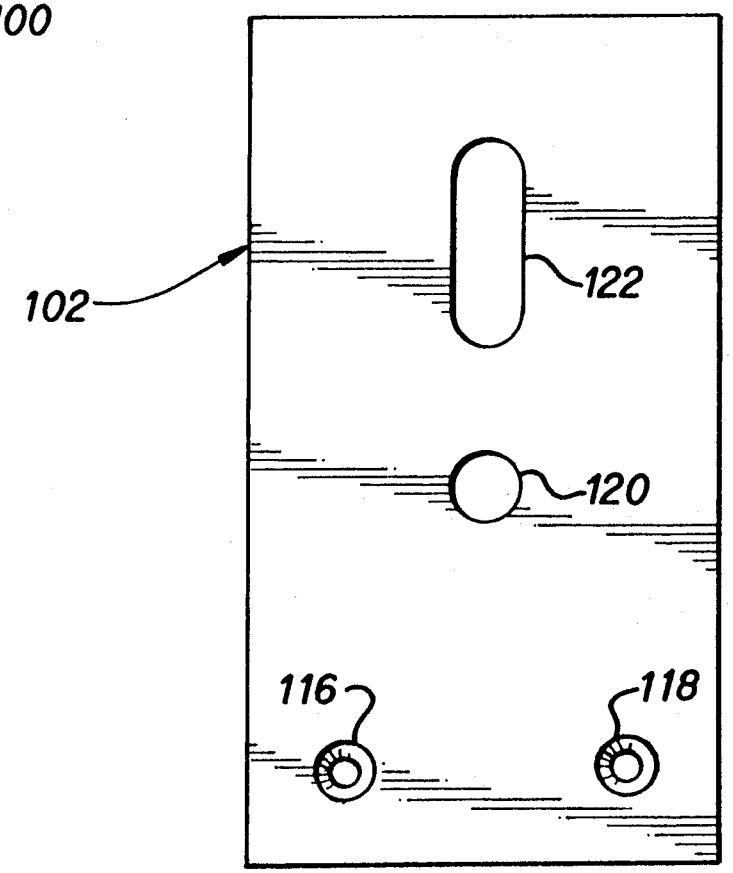
FIG. 6 is a side view of a seat reinforcing plate for the preferred embodiment of FIG. 4.

The first seat reinforcing plate 102 of FIG. 4 is illustrated in FIG. 6. This plate has four holes therein. A first seat plate screw hole 116 and a second seat plate screw hole 118 are provided to affix the first seat reinforcement plate 102 to the first seat member 26. A T-nut hole 120 which is not co-linear with the first seat plate screw hole 116 and the second seat plate screw hole 118 is provided for passage of the T-nut shank to pass therethrough. The fourth slot hole 122 follows the contour of the first slotted opening 62 in the first seat frame end 60. The first seat plate screw hole 116, the second seat plate screw hole 118 and the T-nut hole 120 provide for triangular support putter to resist torsional forces resulting from the forces of the first back frame bolt 88 against the slot hole 122.

Figure 7:
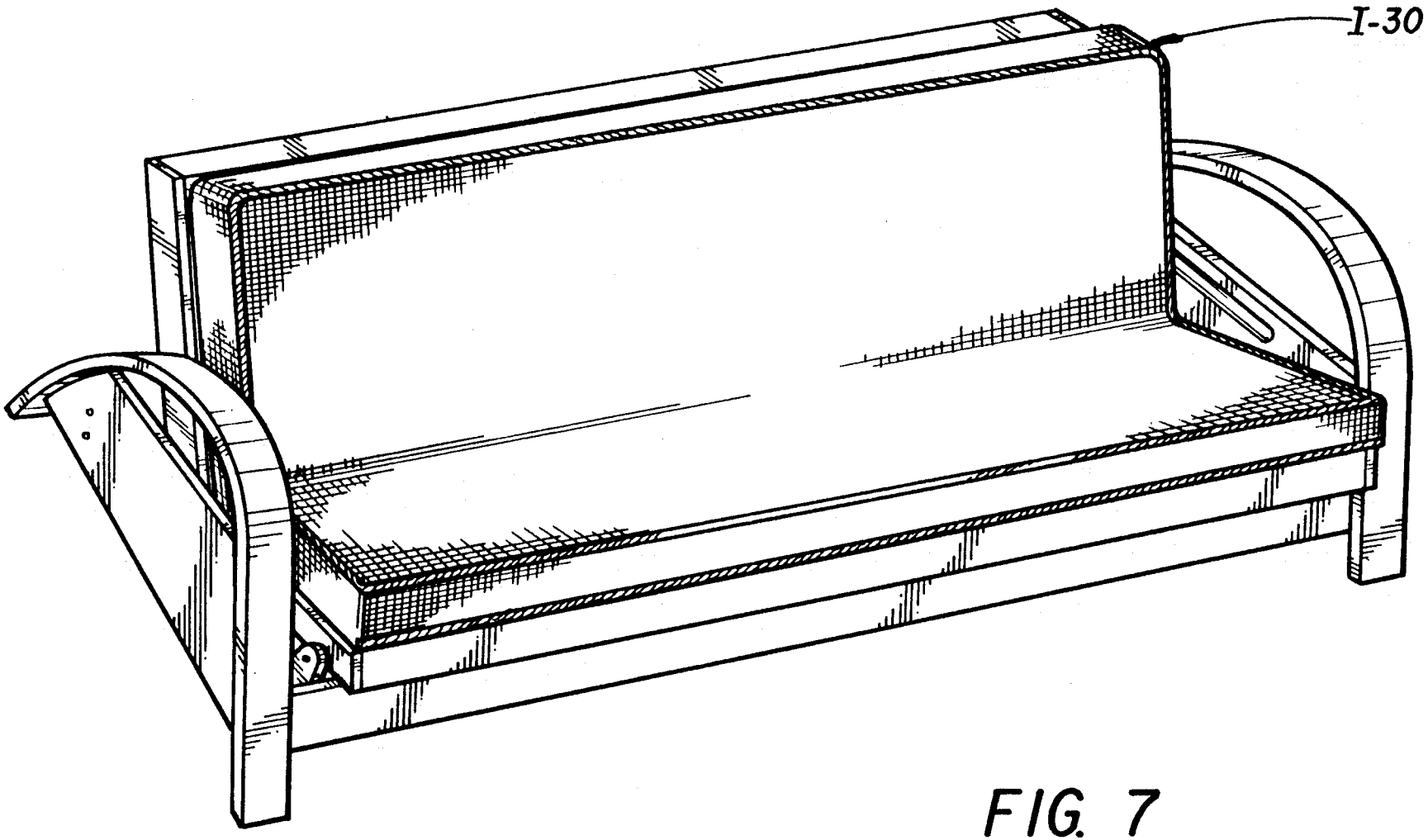
FIG. 7 is a schematic representation of the sofa of FIG. 1 with a sofa pad in place which serves as a back pad and a seat pad when the sofa is closed and serves as a mattress when the sofa is opened.

FIG. 7 illustrates the sofa bed recliner 10 of FIG. 1 with a pad 130 being supported by the sofa bed recliner 10. The weight of the pad 130 is frequently sufficient to maintain the pad in position. The pad 130 can be maintained in position by a hook type fastener 132 shown in FIG. 1 with the hook type fastener 132 engaging the pile of the pad 130.

While the novel features of the present apparatus have been described in terms of particular embodiments and preferred applications, it should be appreciated by one skilled in the art that substitution of materials and details obviously can be made without departing from the spirit of the invention.

What I claim is:

1. A sofa bed recliner comprising:

a main frame having a first main frame end and a second main frame end which are spaced apart from and substantially parallel to each other, said first main frame end having a first guide groove therein and said second main frame end having a second guide groove therein;

a back frame having a first back frame member and a second back frame member which are spaced apart and substantially parallel to each other;

said first back frame member having a first back frame member end with a first longitudinal notch positioned longitudinally therein and a first normal notch substantially normal to said first longitudinal notch, and said second back frame member having a second back frame member end with a second longitudinal notch positioned longitudinally therein and a second normal notch substantially normal to said second longitudinal notch;

a first guide groove follower attached to said first back frame member engaging said first guide groove;

a second guide groove follower attached to said second back frame member engaging said second guide groove;

a first link arm pivotally connected to said first main frame end and to said first back frame member;

a second link arm pivotally connected to said second main frame end and to said second back frame member;

a seat frame having a first seat frame member and a second seat frame member which are spaced apart and substantially parallel to each other, said first seat frame member having a first seat frame member end having a first slotted opening located therein; and said second seat frame member having a second seat frame member end having a second slotted opening located therein;

a first back frame pin attached to said back frame member end of said first back frame member, said first back pin engaging said first slotted opening;

a second back frame pin attached to said second back frame member end of said second back frame member, said second back frame pin engaging said second slotted opening;

a first seat pin attached to said first seat frame member end, said pin so positioned that it can be slidably engaged with said first normal notch and said first longitudinal notch; and a second seat pin attached to said second seat frame member end, said pin being so positioned that it can be slidably engaged with said second normal notch and said second longitudinal notch.

2. The sofa bed recliner of claim 1 further comprising:

a first back reinforcing plate attached to said first back frame member end;

a second back reinforcing plate attached to said second back frame member end;

a first seat reinforcing plate attached to said first seat frame member end; and a second seat reinforcing plate attached to said second seat frame member end.

3. The sofa bed recliner of claim 2 wherein said first guide groove and said second guide groove are blind grooves and further wherein said first guide groove follower and said second guide groove follower are provided with bushings, said bushings rotatably engaging said first guide groove follower and said second guide groove follower and rotatably engaging said first guide groove and said second guide groove.

4. The sofa bed recliner of claim 3 wherein said first groove follower, said second groove follower, said first back frame pin, said second back frame pin, said first seat pin, and said second seat pin are bolts.

5. The sofa bed recliner of claim 4 wherein said bolts are secured with T-nuts.

6. The sofa bed recliner of claim 5 wherein said first back frame member and said second back frame member are positioned adjacent to said first main frame end and said second main frame end respectively.

7. The sofa bed recliner of claim 6 further comprising a first stabilizing leg mounted to said first seat frame member; and a second stabilizing pivotable leg mounted to said second seat frame member.

* * * * *